US008459482B2

(12) United States Patent
Wall et al.

(10) Patent No.: US 8,459,482 B2
(45) Date of Patent: Jun. 11, 2013

(54) FOLDABLE STORAGE CASE

(76) Inventors: Christopher M. Wall, Grand Rapids, MI (US); Phillip W. Chaffee, Rockford, MI (US)

( * ) Notice: Subject to any disclaimer, the term of this patent is extended or adjusted under 35 U.S.C. 154(b) by 159 days.

(21) Appl. No.: 12/963,261

(22) Filed: Dec. 8, 2010

(65) Prior Publication Data

US 2012/0145708 A1 Jun. 14, 2012

(51) Int. Cl.
*B65D 8/14* (2006.01)
*B65D 25/04* (2006.01)

(52) U.S. Cl.
USPC ..... 220/6; 220/4.31; 229/120.04

(58) Field of Classification Search
USPC ..... 220/6, 4.23, 4.31, 4.33, 4.34, 7, 537, 220/839, 62, 62.1, 680, 692; 229/254, 259, 229/145, 149, 152, 154, 127, 141, 142, 143, 229/117, 103.3, 108.1, 117.05, 117.13, 120.04, 229/122.28, 125.19; 206/193, 196
See application file for complete search history.

(56) References Cited

U.S. PATENT DOCUMENTS

| | | | | | |
|---|---|---|---|---|---|
| 1,697,969 | A | * | 1/1929 | Boeye | 229/122.26 |
| 1,894,226 | A | * | 1/1933 | Ross | 229/143 |
| 2,089,694 | A | | 8/1935 | Fallert | |
| 2,276,820 | A | * | 3/1942 | Bonfield | 229/143 |
| 2,315,094 | A | * | 3/1943 | Rehfield et al. | 229/122.24 |
| 2,719,665 | A | * | 10/1955 | Tharpe et al. | 229/117.09 |
| 2,741,415 | A | | 4/1956 | Meitzen | |
| 2,989,223 | A | * | 6/1961 | Magazzu | 206/521.1 |
| 3,170,616 | A | | 2/1965 | Crozier | |
| 3,207,414 | A | * | 9/1965 | Locke et al. | 229/125 |
| 3,270,947 | A | * | 9/1966 | Rasmussen | 229/222 |
| 3,286,908 | A | | 11/1966 | Ellis | |
| 3,752,385 | A | * | 8/1973 | Woodgate | 229/120.07 |
| 4,007,869 | A | | 2/1977 | Stolkin et al. | |
| 4,314,639 | A | | 2/1982 | Gloyer | |
| 4,967,901 | A | | 11/1990 | Wood | |
| 5,289,970 | A | * | 3/1994 | McClure | 229/143 |
| 5,588,585 | A | * | 12/1996 | McClure | 229/191 |
| 5,769,309 | A | * | 6/1998 | Beneroff et al. | 229/167 |
| 5,823,424 | A | * | 10/1998 | Allen | 229/120.07 |
| 5,871,145 | A | | 2/1999 | Hermann et al. | |
| 6,302,320 | B1 | | 10/2001 | Stout | |
| 6,349,876 | B1 | * | 2/2002 | Dowd | 229/155 |
| 7,121,453 | B2 | * | 10/2006 | Nass | 229/177 |
| 7,290,696 | B2 | * | 11/2007 | McClure | 229/143 |
| 7,780,068 | B2 | * | 8/2010 | Donnelly | 229/117.25 |
| 2001/0032874 | A1 | * | 10/2001 | Philips | 229/143 |
| 2008/0011621 | A1 | | 1/2008 | Liu et al. | |

* cited by examiner

*Primary Examiner* — J. Gregory Pickett
*Assistant Examiner* — Ernesto Grano
(74) *Attorney, Agent, or Firm* — Paparella & Associates, PC; Joseph A. Paparella

(57) ABSTRACT

A foldable storage case comprises a one-piece, waterproof container. The container comprises a body, a bottom, and a cover, where the body, the bottom, and the cover form an interior space therebetween. The body comprises a plurality of body panels, the bottom comprises a plurality of bottom panels, and the cover comprises a plurality of cover panels. A plurality of removable fasteners is used to fasten together the body panels and the bottom panels. Further, each cover panel includes a projection adapted to be received by a receiving area of at least one of the body panels. When the cover is folded such that two or more projections are disposed adjacent each other within the receiving area, the projections and the receiving area interfere with each other, detachably securing the cover panels in place.

11 Claims, 8 Drawing Sheets

FOLDABLE STORAGE CASE

BACKGROUND OF THE INVENTION

The present invention relates to storage cases, and more particularly to foldable storage cases.

In order to simplify production and to limit shipping costs, many present storage cases include a one-piece panel structure wherein a plurality of panels are joined by foldable hinges. These storage cases typically include a corrugated cardboard construction and, when assembled, are held in the assembled position by glue, staples or an adhesive tape.

Although simple and cost effective, a number of problems arise from these existing storage cases. One problem is that the cardboard construction of existing cases is susceptible to water damage. For example, if a case is storing a breakable liquid container, such as a glass beer bottle, an accidental break or overflow can cause permanent damage to the storage case, rendering it unfit for storage and transport.

Another disadvantage of existing one-piece storage cases is their inability to withstand repeated use. The staples and adhesive tape used to hold existing cases together damage cases every time they are removed. Further, adhesive tape tends to wear out after repeated use, and needs to be removed and replaced over time, causing additional damage.

Still more disadvantages arise from the cover construction of existing storage cases. Due to the need to be able to repeatedly open and close case covers, existing covers rely on adhesive tape in order to be held in a closed position. Again, the constant removal and reapplication of tape over time will cause damage to a case. Furthermore, many one-piece cases, especially those made of thicker, sturdier materials, have cover panels that tend to return to an upright position when left unobstructed, further adding to the need for an adhesive to hold the cover panels in a closed position.

Consequently, there is a need for a foldable storage case made of a waterproof material that is able to withstand prolonged use, including repeated assembly and disassembly. To that end, a need exists for a novel foldable storage case that is held together by fasteners that do not cause damage to the case body. Furthermore, a need exists for a cover of the same material that is flexibly hinged and is able to be secured in a closed position without using a damage-causing adhesive tape. Therefore, a foldable storage case that solves the aforementioned disadvantages and having the aforementioned advantages is desired.

SUMMARY OF THE PRESENT INVENTION

The aforementioned drawbacks and disadvantages of these former storage cases have been identified and a solution is set forth herein by the inventive foldable storage case which comprises a one-piece container that comprises a body, a bottom, and a cover, wherein the body, the bottom, and the cover are adapted to form an interior space therebetween. The body comprises a plurality of body panels. At least one of the body panels comprises a first overlapping body area. At least one of the body panels comprises a second overlapping body area adapted to be disposed adjacent the first overlapping body area. The first overlapping body area and the second overlapping body area comprise at least one body aperture. When the first overlapping body area and the second overlapping body area overlap, the body aperture of the first overlapping body area and the body aperture of the second overlapping body area align to form a body aperture pair therethrough. The bottom comprises a plurality of bottom panels. Each bottom panel is hingedly joined to at least one body panel. At least one bottom panel comprises a first overlapping bottom area. At least one bottom panel comprises a second overlapping bottom area adapted to be disposed adjacent the first overlapping bottom area. The first overlapping bottom area and the second overlapping bottom area comprise at least one bottom aperture. When the first overlapping bottom area and the second overlapping bottom area overlap, the bottom aperture of the first overlapping bottom area and the bottom aperture of the second overlapping bottom area align to form a bottom aperture pair therethrough. The cover comprises a plurality of cover panels. The cover panels comprise a hinged end and a free end. The hinged end is adapted to be hingedly joined to one of the body panels by at least one cover hinge. The free end comprises a projection adapted to be received by a receiving area of at least one of the body panels. When the cover is folded along the cover hinge such that the projections of at least two of the cover panels are disposed adjacent each other within the receiving area, the projections and the receiving area interfere with each other such that the projections and the receiving area detachably secure the cover panels in place. The foldable storage case further comprises a plurality of removable fasteners. The removable fasteners are adapted to be disposed in the body aperture pair and the bottom aperture pair, thereby fastening together the body panels and the bottom panels, respectively.

Another aspect of the present invention comprises a one-piece container comprising a waterproof material. The container comprises a body, a bottom, and a cover, wherein the body, the bottom, and the cover are adapted to form an interior space therebetween. The body comprises a first end panel. The first end panel comprises at least one first body aperture. The first end panel is hingedly joined to a first side panel. The first side panel is hingedly joined to second end panel. The second end panel is hingedly joined to a second side panel. The second side panel is hingedly joined to a connecting flap. The connecting flap comprises at least one second body aperture. At least one of the first side panel, the second side panel, the first end panel, and the second end panel further comprises an integral handle. The handle comprises a flap adapted to be hingedly joined to the first side panel, the second side panel, the first end panel, or the second end panel by at least one scored handle hinge. The handle hinge is adapted to adjust the flap from a closed position, wherein the flap forms the same plane as the first side panel, the second side panel, the first end panel, or the second end panel, to an open position, wherein the flap is disposed into the interior space of the container, thereby creating a handling aperture whereby a user may use the handling aperture to grasp the container. The bottom comprises two first bottom panels. Each first bottom panel is hingedly joined to one of the first end panel and the second end panel. Each first bottom panel comprises at least one first bottom aperture. The bottom further comprises two second bottom panels. Each second bottom panel is hingedly joined to one of the first side panel and the second side panel. Each second bottom panel comprises at least one second bottom aperture. The cover comprises two cover panels. The cover panels comprise a hinged end, a free end, and two side flaps. The hinged end is adapted to be hingedly joined to one of the first end panel, the second end panel, the first side panel, and the second side panel by two or more scored cover hinges. The cover hinges are disposed apart from each other along the hinged end, thereby creating at least one space between the cover hinges, thereby reducing contact between the cover panels and the body, thereby increasing flexibility of the hinged end and aiding in adjustment of the cover panels. The free end comprises a projection and two closure flaps. The projection is adapted to be received by a receiving area of at least one of the first end panel, the second end panel, the first side panel, and the second side panel. The closure flaps are adapted to be extended from and hingedly joined to the projection. The closure flaps comprise at least one end aperture. The side flaps are adapted to be extended from and hingedly joined to the cover panel. The side flaps comprise at least one side aperture. The foldable storage case further comprises a plurality of removable fasteners. When the body is folded such that the first end panel and the connecting flap overlap, the at least one first body aperture aligns with the at least one second body aperture, forming a body aperture pair therethrough, wherein at least one of the fasteners may be disposed in the body aperture pair and thereby fasten together the connecting flap and the first end panel. When the bottom is folded such that at least one of the first bottom panels and at least one of the second bottom panels overlap, the at least one first bottom aperture aligns with the at least one second bottom aperture, forming a bottom aperture pair therethrough, wherein at least one of the fasteners may be disposed in the bottom aperture pair and thereby fasten together the first bottom panel and the second bottom panel. When the cover panels are folded such that at least one of the closure flaps and at least one of the side flaps overlap, the at least one end aperture aligns with the at least one side aperture, forming a cover aperture pair therethrough, wherein at least one of the fasteners may be disposed in the cover aperture pair and thereby fasten together the closure flap and the side flap. When the cover is folded along the cover hinges such that the projections of the cover panels are disposed adjacent each other within the receiving area, the projections and the receiving area interfere with each other such that the projections and the receiving area detachably secure the cover panels in place.

In yet another aspect of the present invention, a foldable storage case comprises a waterproof material. The container comprises a body, a bottom, and a cover, wherein the body, the bottom, and the cover are adapted to form an interior space therebetween. The body comprises a first end panel. The first end panel comprises at least one first body aperture. The first end panel is hingedly joined to a first side panel. The first side panel is hingedly joined to a second end panel. The second end panel is hingedly joined to a second side panel. The second side panel is hingedly joined to a connecting flap. The connecting flap comprises at least one second body aperture. The length x of the first side panel and the second side panel is greater than the length y of the first end panel and the second end panel. At least one of the first end panel and the second end panel further comprises an integral handle. The handle comprises a flap adapted to be hingedly joined to the first end panel and the second end panel by at least one scored handle hinge. The handle hinge is adapted to adjust the flap from a closed position, wherein the flap forms the same plane as the first end panel or the second end panel, to an open position, wherein the flap is disposed into the interior space of the container, thereby creating a handling aperture whereby a user may use the handling aperture to grasp the container. The bottom comprises two first bottom panels. Each first bottom panel is hingedly joined to one of the first end panel and the second end panel. Each first bottom panel comprises at least one first bottom aperture. The bottom further comprises two second bottom panels. Each second bottom panel is hingedly joined to one of the first side panel and the second side panel. Each second bottom panel comprises at least one second bottom aperture. The cover comprises two cover panels. The cover panels comprise a hinged end, a free end, and two side flaps. The hinged end is adapted to be hingedly joined to one of the first side panel and the second side panel by two or more scored cover hinges. The cover hinges are disposed apart from each other along the hinged end, thereby creating at least one space between the cover hinges, thereby reducing contact between the cover panels and the body, thereby increasing flexibility of the hinged ends and aiding in adjustment of the cover panels. The free end comprises a projection and two closure flaps. The projection is adapted to be received by a receiving area of at least one of the first end panel and the second end panel. The closure flaps are adapted to be extended from and hingedly joined to the projection. The closure flaps comprise at least one end aperture. The side flaps are adapted to be extended from and hingedly joined to the cover panel. The side flaps comprise at least one side aperture. The foldable storage case further comprises a plurality of removable fasteners. The fasteners comprise screws. The foldable storage case further comprises a divider adapted to be disposed in the interior space of the container. When the body is folded such that the first end panel and the connecting flap overlap, the at least one first body aperture aligns with the at least one second body aperture, forming a body aperture pair therethrough, wherein at least one of the fasteners may be disposed in the body aperture pair and thereby fasten together the connecting flap and the first end panel. When the bottom is folded such that at least one of the first bottom panels and at least one of the second bottom panels overlap, the at least one first bottom aperture aligns with the at least one second bottom aperture, forming a bottom aperture pair therethrough, wherein at least one of the fasteners may be disposed in the bottom aperture pair and thereby fasten together the first bottom panel and the second bottom panel. When the cover panels are folded such that at least one of the closure flaps and at least one of the side flaps overlap, the at least one end aperture aligns with the at least one side aperture, forming a cover aperture pair therethrough, wherein at least one of the fasteners may be disposed in the cover aperture pair and thereby fasten together the closure flap and the side flap. When the cover is folded along the cover hinges such that the projections of the cover panels are disposed adjacent each other within the receiving area, the projections and the receiving area interfere with each other such that the projections and the receiving area detachably secure the cover panels in place. When the divider is disposed in the interior space of the container, and when the at least one flap of the handle is in the open position, the flap detachably secures the divider in place and prevents the divider from being removed from the interior space of the container.

In still yet another aspect of the present invention, a foldable storage case comprises a one-piece container comprising a waterproof material. The container comprises a body, a bottom, and a cover, wherein the body, the bottom, and the cover are adapted to form an interior space therebetween. The body comprises a plurality of body panels. At least one of the body panels comprises a first overlapping body area. At least one of the body panels comprises a second overlapping body area adapted to be disposed adjacent the first overlapping body area. The first overlapping body area and the second overlapping body area comprise at least one body aperture. When the first overlapping body area and the second overlapping body area overlap, the body aperture of the first overlapping body area and the body aperture of the second overlapping body area align to form a body aperture pair therethrough. The bottom comprises a plurality of bottom panels. Each bottom panel is hingedly joined to at least one body panel. At least one bottom panel comprises a first overlapping bottom area. At least one bottom panel comprises a second overlapping bottom area adapted to be disposed adjacent the first overlapping bottom area. The first overlapping bottom area and the second overlapping bottom area comprise at least one bottom aperture. When the first overlapping bottom area and the second overlapping bottom area overlap, the bottom aperture of the first overlapping bottom area and the bottom aperture of the second overlapping bottom area align to form a bottom aperture pair therethrough. The cover comprises a plurality of cover panels. The cover panels comprise a hinged end and a free end. The hinged end is adapted to be hingedly joined to one of the body panels by at least one cover hinge. The free end comprises a projection adapted to be received by a receiving area of at least one of the body panels. When the cover is folded along the cover hinge such that the projections of at least two of the cover panels are disposed adjacent each other within the receiving area, the projections and the receiving area interfere with each other such that the projections and the receiving area detachably secure the cover panels in place. The foldable storage case further comprises a plurality of removable fasteners. The removable fasteners are adapted to be disposed in the body aperture pair and the bottom aperture pair, thereby fastening together the body panels and the bottom panels, respectively.

As such, those skilled in the art will appreciate that the conception upon which this disclosure is based may readily be used as a basis for designing other structures, methods, and systems for carrying out the several purposes of the present invention. It is important therefore that the claims are regarded as including such equivalent constructions, as far as they do not depart from the spirit and scope of the present invention.

Further, the purpose of the Abstract is to enable the United States Patent and Trademark Office, the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any manner.

These and other objects, along with the various features and structures that characterize the invention, are pointed out with particularity in the claims annexed to and forming a part of this disclosure. For a better understanding of the foldable storage case of the present disclosure, its advantages, and the specific traits attained by its use, reference should be made to the accompanying drawings and other descriptive matter in which there are illustrated and described the preferred embodiments of the invention.

As such, while embodiments of the foldable storage case are herein illustrated and described, it is to be appreciated that various changes, rearrangements, and modifications may be made therein without departing from the scope of the invention as defined by the claims.

BRIEF DESCRIPTION OF THE DRAWINGS

As a compliment to the description and for better understanding of the specification presented herein, 8 pages of drawings are disclosed with an informative, but not limiting, intention.

DETAILED DESCRIPTION OF THE PREFERRED EMBODIMENT

Figure 1:
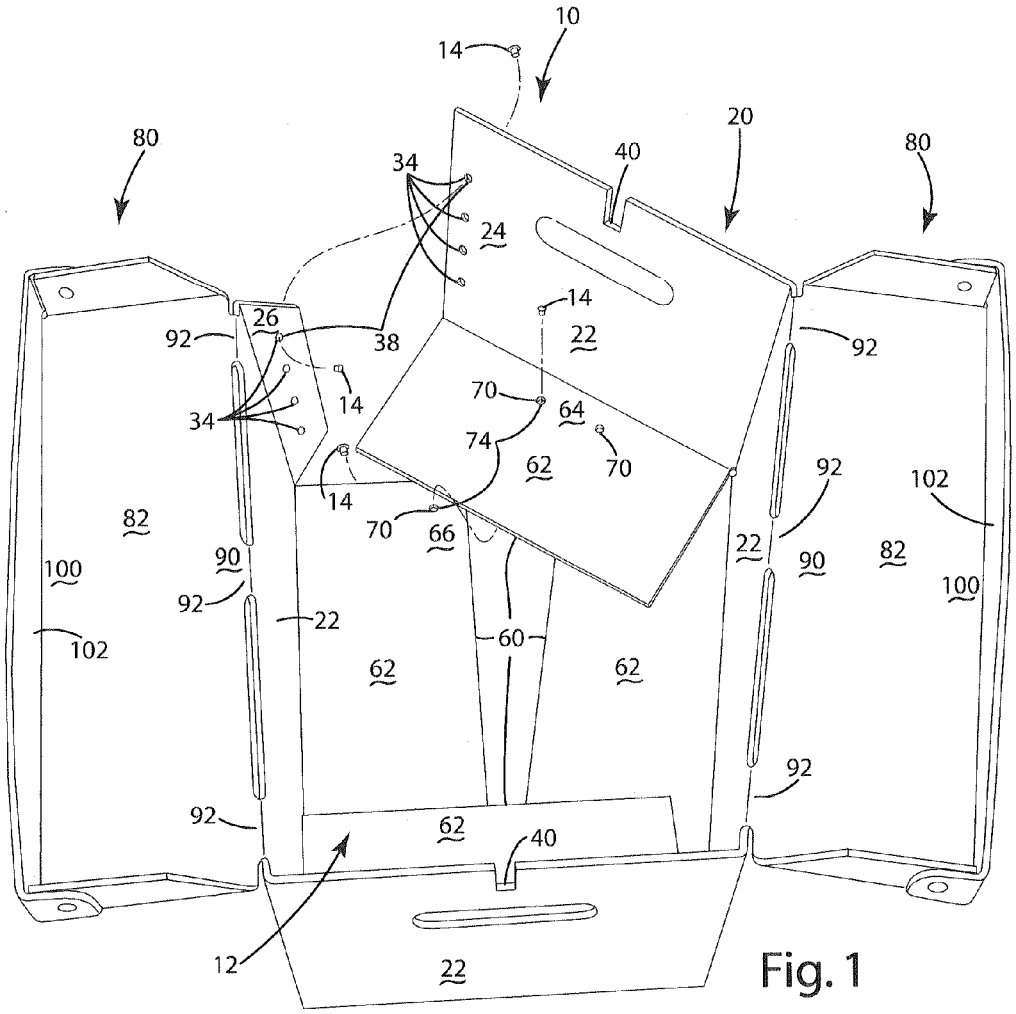
FIG. 1 is a perspective view of an embodiment of the foldable storage case of the present invention.

The best mode for carrying out the invention is presented in terms of the preferred embodiment, wherein similar referenced characters designate corresponding features throughout the several figures of the drawings.

As used herein, the term waterproof is meant to be used and defined in its general, broad sense. To wit, waterproof means resistant to the absorption and penetration of water. As used herein, waterproof does not necessarily mean that an object is completely impervious to water. Rather, it means that that the object is particularly resistant to water. Of course, this is not meant to be limiting in any manner and waterproof may be used for numerous purposes as is generally known in the art.

Reference will now be made in detail to the present preferred embodiments of the invention, examples of which are illustrated in the accompanying drawings. Wherever possible, these same referenced numerals will be used throughout the drawings to refer to the same or like parts. Like features between the various embodiments utilize similar numerical designations. Where appropriate, the various similar features have been further differentiated by an alphanumeric designation, wherein the corresponding alphabetic designator has been changed. Further, the dimensions illustrated in the drawings (if provided) are included for purposes of example only and are not intended to limit the scope of the present invention. Additionally, particular details in the drawings which are illustrated in hidden or dashed lines are to be considered as forming no part of the present invention.

The disadvantages and drawbacks of the prior art are overcome through the foldable storage case of the present invention, wherein one preferred embodiment is disclosed in FIG. 1. Referring now to FIG. 1, there is shown a foldable storage case which comprises a one-piece container 10 that comprises a body 20, a bottom 60, and a cover 80, wherein the body 20, the bottom 60, and the cover 80 are adapted to form an interior space 12 therebetween.

In one embodiment, the container 10 may comprise any known material adapted to resist water and therefore prevent water damage to the container 10. For example, the container 10 may comprise a corrugated plastic material or a cardboard material coated with a waterproofing agent. Of course, this is not meant to be limiting in any way and container 10 may comprise any known waterproof material and may utilize any waterproofing process known in the art.

The body 20 comprises a plurality of body panels 22. At least one of the body panels 22 comprises a first overlapping body area 24. At least one of the body panels 22 comprises a second overlapping body area 26 adapted to be disposed adjacent the first overlapping body area 24. The first overlapping body area 24 and the second overlapping body area 26 comprise at least one body aperture 34. When the first overlapping body area 24 and the second overlapping body area 26 overlap, the body aperture 34 of the first overlapping body area 24 and the body aperture 34 of the second overlapping body area 26 align to form a body aperture pair 38 therethrough.

The first overlapping body area 24 and the second overlapping body area 26 may comprise any area known in the art. For example, in one embodiment of the invention, the first overlapping body area 24 and the second overlapping body area 26 may comprise flaps. In another embodiment of the invention, the first overlapping body area 24 and the second overlapping body area 26 may include the entire respective body panel 22. Of course, this is not meant to be limiting in any way.

The body aperture 34 may comprise any aperture known in the art. For example, the body aperture 34 may comprise a gap, a hole, an opening, a perforation, a slit, a slot, or the like. Of course, this is not meant to be limiting in any way.

The bottom 60 comprises a plurality of bottom panels 62. Each bottom panel 62 is hingedly joined to at least one of the body panels 22. At least one of the bottom panels 62 comprises a first overlapping bottom area 64. At least one of the bottom panels 62 comprises a second overlapping bottom area 66 adapted to be disposed adjacent the first overlapping bottom area 64. The first overlapping bottom area 64 and the second overlapping bottom area 64 comprise at least one bottom aperture 70. When the first overlapping bottom area 64 and the second overlapping bottom area 66 overlap, the bottom aperture 70 of the first overlapping bottom area 64 and the bottom aperture 70 of the second overlapping bottom area 66 align to form a bottom aperture pair 74 therethrough.

The bottom panels 62 may be hingedly joined to the body panels 22 by any method or device as is known in the art. For example, the bottom panels 62 may be hingedly joined to the body panels 22 in any such way that allows the bottom panels 66 to be turned, swung, or moved on an axis in relation to the body panels 22. In one embodiment of the invention, the bottom panels 62 are hingedly joined to the body panels 22 by a scored hinge. In another embodiment of the invention, the bottom panels 62 are hingedly joined to the body panels 22 by a plurality of hinges. Of course, this is not meant to be limiting in any way.

The first overlapping bottom area 64 and the second overlapping bottom area 66 may comprise any area known in the art. For example, in one embodiment of the invention, the first overlapping bottom area 64 and the second overlapping bottom area 66 may comprise flaps. In another embodiment of the invention, the first overlapping bottom area 64 and the second overlapping bottom area 66 may include the entire respective bottom panel 62. Of course, this is not meant to be limiting in any way.

The bottom aperture 70 may comprise any aperture known in the art. For example, the bottom aperture 70 may comprise a gap, a hole, an opening, a perforation, a slit, a slot, or the like. Of course, this is not meant to be limiting in any way.

Figure 2:
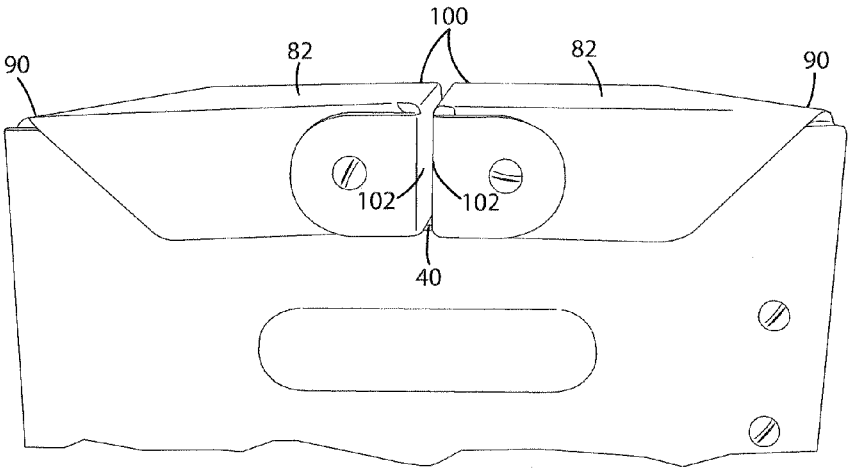
FIG. 2 is a front view of the foldable storage case of FIG. 1.

The cover 80 comprises a plurality of cover panels 82. The cover panels 82 comprise a hinged end 90 and a free end 100. The hinged end 90 is adapted to be hingedly joined to one of the body panels 22 by at least one cover hinge 92. The free end 100 comprises a projection 102 adapted to be received by a receiving area 40 of at least one of the body panels 22. When the cover 80 is folded along the cover hinge 92 such that the projections 102 of at least two of the cover panels 82 are disposed adjacent each other within at least one receiving area 40, the projections 102 and the receiving area 40 interfere with each other such that the projections 102 and the receiving area 40 detachably secure the cover panels 82 in place. See, for example, FIG. 2.

When the projections 102 are disposed adjacent each other within the receiving area 40, the interference between the projections 102 and the receiving area 40 may be of any amount wherein the cover panels 82 are detachably secured in place. In one embodiment of the invention, the amount of interference between the at least two projections 102 is greater than the amount of interference between the projections 102 and the receiving area 40. In another embodiment, the amount of interference between the projections 102 and the receiving area 40 is greater than the amount of interference between the at least two projections 102. Furthermore, in another embodiment of the invention, a user may detach the projections 102 from the receiving area 40 by using a minimal amount of force. In yet another embodiment of the invention, the user may detach the projections 102 from the receiving area 40 only after removing a securing mechanism such as a lock or a fastener 14. Of course, this is not meant to be limiting in any way and the amount of interference between the projections 102 and the receiving area 40, the force required to detach the projections 102, and the method used to detach the projections 102 may be any interference, force, or method known in the art.

Referring again to FIG. 1, the cover hinge 92 may comprise any known object adapted to hingedly join the cover panels 82 to the body panels 22. In one embodiment of the present invention, the cover hinge 92 comprises a scored hinge. In another embodiment of the present invention, the hinged end 90 of the cover panels 82 comprises a plurality of cover hinges 92. See, for example, FIG. 8. The cover hinges 92 are disposed apart from each other along the hinged end 90, creating at least one space 94 between the cover hinges 92. The space 94 reduces contact between the cover panels 82 and the body 20 and thereby increases flexibility of the hinged end 90 and aids in adjustment of the cover panels 82. In yet another embodiment, the hinged end 90 comprises exactly three cover hinges 92 disposed apart from each other along the hinged end 90, creating exactly two spaces 94 between the cover hinges 92.

Referring back to FIG. 1, the receiving area 40 may comprise any known area adapted to receive at least two projections 102 of the cover panels 82. In one embodiment of the present invention, the receiving area 40 comprises a U-shaped slot cut out of the respective body panel 22. In another embodiment, the receiving area 40 recesses from the top of the respective body panel 22. Of course, this is not meant to be limiting in any way and the receiving area 40 may comprise any area known in the art.

The foldable storage case further comprises a plurality of removable fasteners 14. The removable fasteners 14 are adapted to be disposed in the body aperture pair 38 and the bottom aperture pair 74, thereby fastening together the body panels 22 and the bottom panels 62, respectively.

The fasteners 14 may comprise any known object adapted to be disposed in the body aperture pair 38 or the bottom aperture pair 74 to thereby fasten together either the body panels 22 or the bottom panels 62, respectively. In one embodiment of the invention, the fasteners 14 comprise screws. The fasteners 14 may comprise any known screws, including, but not limited to, self-threading screws or non-tapered screws. Further, the fasteners 14 may comprise screws adapted to mate with an internal thread of the respective body aperture pair 38 or bottom aperture pair 74. In another embodiment, the fasteners 14 comprise two-piece screws wherein the thread of one piece of the screw is adapted to mate with an internal thread of the other piece of the screw. In this embodiment, the screw pieces enter the body aperture pair 38 or bottom aperture pair 74 from opposite ends and join in the middle of the respective body aperture pair 38 or bottom aperture pair 74, thereby fastening together the body panels 22 or the bottom panels 62, respectively. Of course, this is not meant to be limiting in any way and fasteners 14 may comprise any object known in the art.

Furthermore, the fasteners 14 may comprise any known material adapted to be disposed in the body aperture pair 38 or the bottom aperture pair 74 to thereby fasten together either the body panels 22 or the bottom panels 62, respectively. For example, the fasteners 14 may comprise wood, plastic, rubber, a thermoplastic material, metal such as copper or stainless steel, or the like. Of course, this is not meant to be limiting in any way and fasteners 14 may comprise any such material known in the art.

Figure 3:
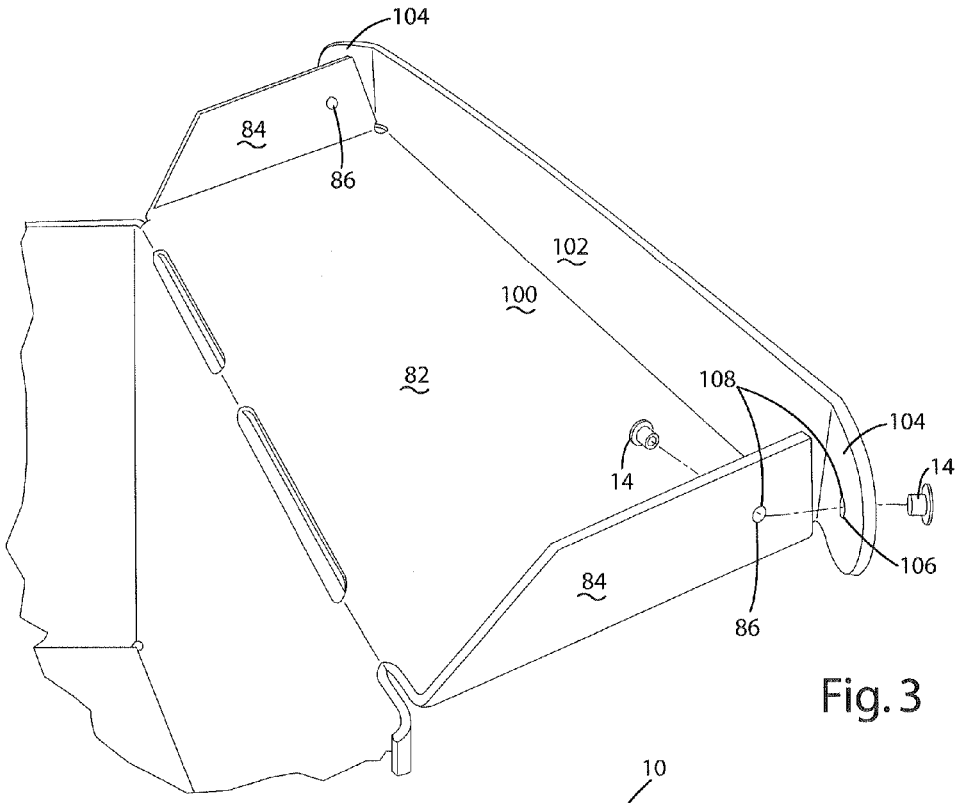
FIG. 3 is a perspective view of the foldable storage case of FIG. 1.

Referring now to FIG. 3, the free end 100 of the cover panels 82 may further comprise two closure flaps 104. The closure flaps 104 are adapted to be extended from and hingedly joined to the projection 102. The closure flaps 104 comprise at least one end aperture 106. The cover panels 82 may further comprise two side flaps 84. The side flaps 84 are adapted to be extended from and hingedly joined to the cover panel 82. The side flaps 84 comprise at least one side aperture 86.

The closure flaps 104 may be hingedly joined to the projection 102 and the side flaps 84 may be hingedly joined to the cover panel 82 by any method or device as is known in the art. For example, the closure flaps 104 may be hingedly joined to the projection 102 and the side flaps 84 may be hingedly joined to the cover panel 82 in any such way that allows the closure flaps 104 and the side flaps 84 to be turned, swung, or moved on an axis in relation to the projection 102 and the cover panel 82, respectively. In one embodiment of the invention, the closure flaps 104 are hingedly joined to the projection 102 and the side flaps 84 are hingedly joined to the cover panel 82 by a scored hinge. In another embodiment of the invention, the closure flaps 104 are hingedly joined to the projection 102 and the side flaps 84 are hingedly joined to the cover panel 82 by a plurality of hinges. Of course, this is not meant to be limiting in any way.

The end aperture 106 and the side aperture 86 may comprise any aperture known in the art. For example, the end aperture 106 and the side aperture 86 may comprise a gap, a hole, an opening, a perforation, a slit, a slot, or the like. Of course, this is not meant to be limiting in any way.

When the cover panels 82 are folded such that at least one of the closure flaps 104 and at least one of the side flaps 84 overlap, the at least one end aperture 106 and the at least one side aperture 86 align to form a cover aperture pair 108 therethrough, wherein at least one of the fasteners 14 may be disposed in the cover aperture pair 108 and thereby fasten together the closure flap 104 and the side flap 84. In one embodiment of the present invention, when the cover panels 82 are folded such that at least one of the fasteners 14 is disposed in the cover aperture pair 108, the projection 102 is disposed in a plane perpendicular to the closure flap 104 and the side flap 84.

Figure 4:
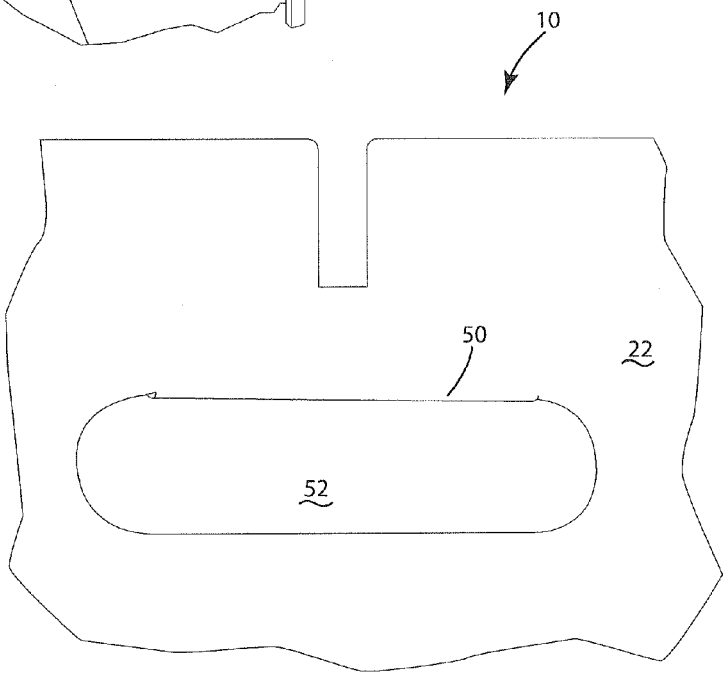
FIG. 4 is an enlarged front view of the foldable storage case of FIG. 1.

Referring now to FIG. 4, at least one of the body panels 22 may further comprise an integral handle 50. The handle 50 comprises a handling aperture 52, whereby a user may use the handling aperture 52 to grasp the container 10. In one embodiment of the present invention, the handling aperture 52 may comprise an oval shape. In another embodiment of the present invention, the handling aperture 52 may comprise a rectangular shape. In yet another embodiment of the present invention, the handling aperture 52 may comprise a shape including individual finger ridges adapted to receive a user's fingers. Of course, this is not meant to be limiting in any way and the handling aperture 52 may comprise any shape which enables the user to grasp the container 10 at the handling aperture 52.

Figure 5:
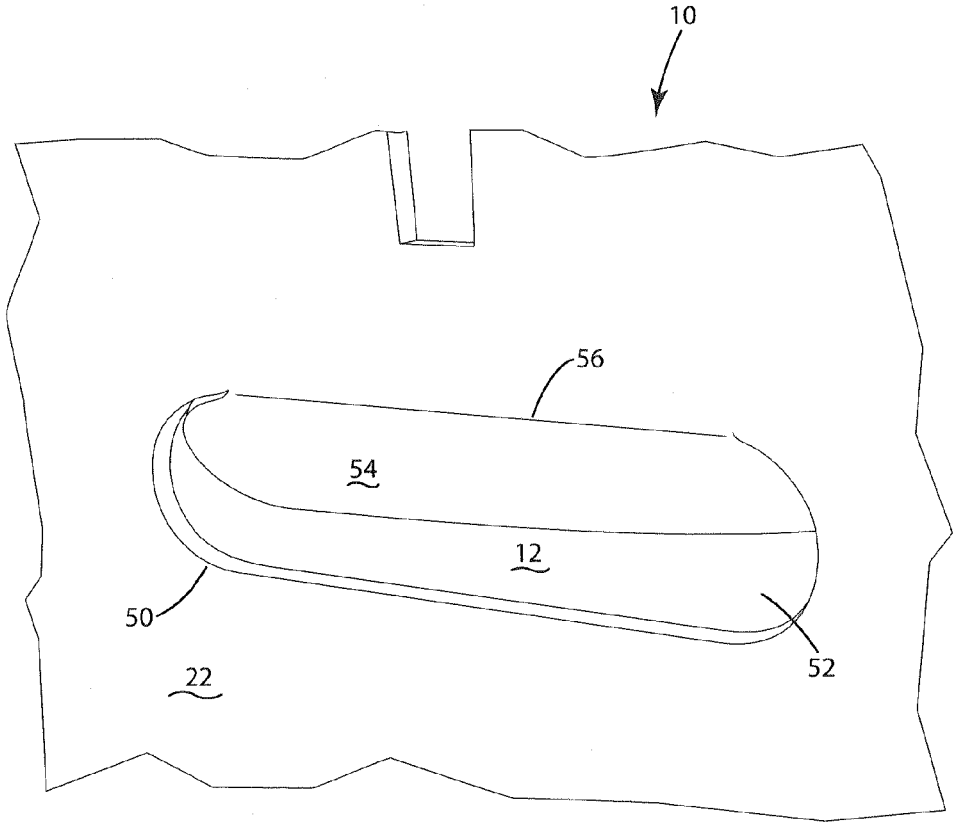
FIG. 5 is an enlarged perspective view of the foldable storage case of FIG. 1.

As illustrated in FIG. 5, the handle 50 may further comprise a flap 54 adapted to be hingedly joined to the body panel 22 by at least one handle hinge 56. The handle hinge 56 is adapted to adjust the flap 54 from a closed position, wherein the flap 54 forms the same plane as the body panel 22 and thereby fills the handling aperture 52, to an open position, wherein the flap 54 is disposed into the interior space 12 of the container 10, thereby opening the handling aperture 52 and enabling a user to grasp the container 10 at the handling aperture 52

Figure 6:
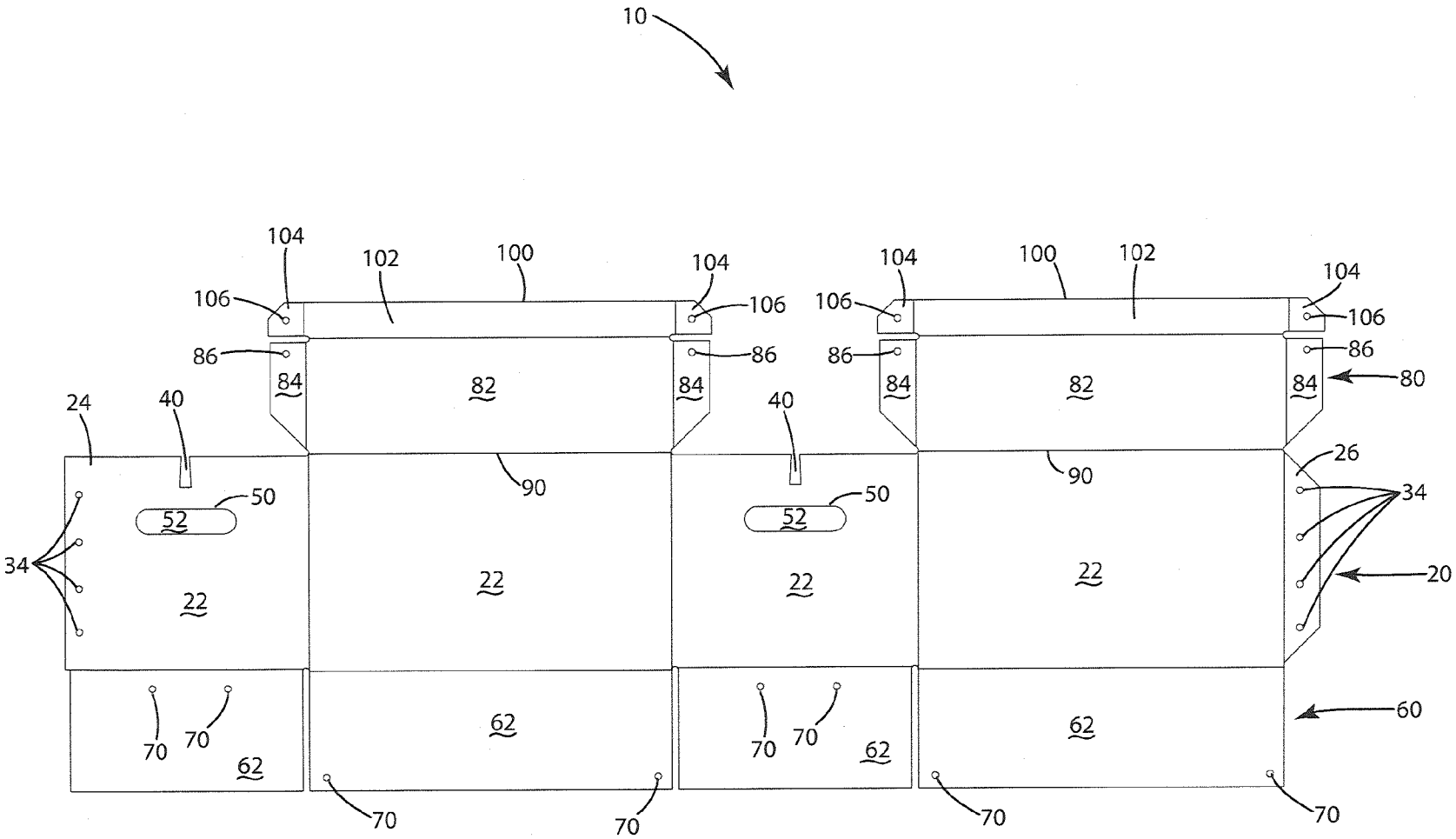
FIG. 6 is a plan view of the foldable storage case of FIG. 1.

In use, the container 10 is adapted to fold from an unassembled position to an assembled position. FIG. 6 illustrates an embodiment of the present invention wherein the container 10 is in the unassembled position. When in the unassembled position, the container 10 is disposed in a flat configuration and is therefore adapted to be easily packaged and shipped. Referring back to FIG. 1, when a user desires to use the container 10, the user may fold the container 10 to the assembled position, wherein the fasteners 14 are disposed in the body aperture pair 38 and the bottom aperture pair 74, thereby fastening together the body panels 22 and the bottom panels 62, respectively. When in the assembled position the container 10 is adapted to receive various objects in the interior space 12. In one embodiment, when the container 10 is in the assembled position, the body panels 22 are disposed such that the body panels 22 form a rectangular shape, and the bottom panels 62 are disposed such that the bottom panels 62 form a plane that is perpendicular to the body panels 22.

Figure 7:
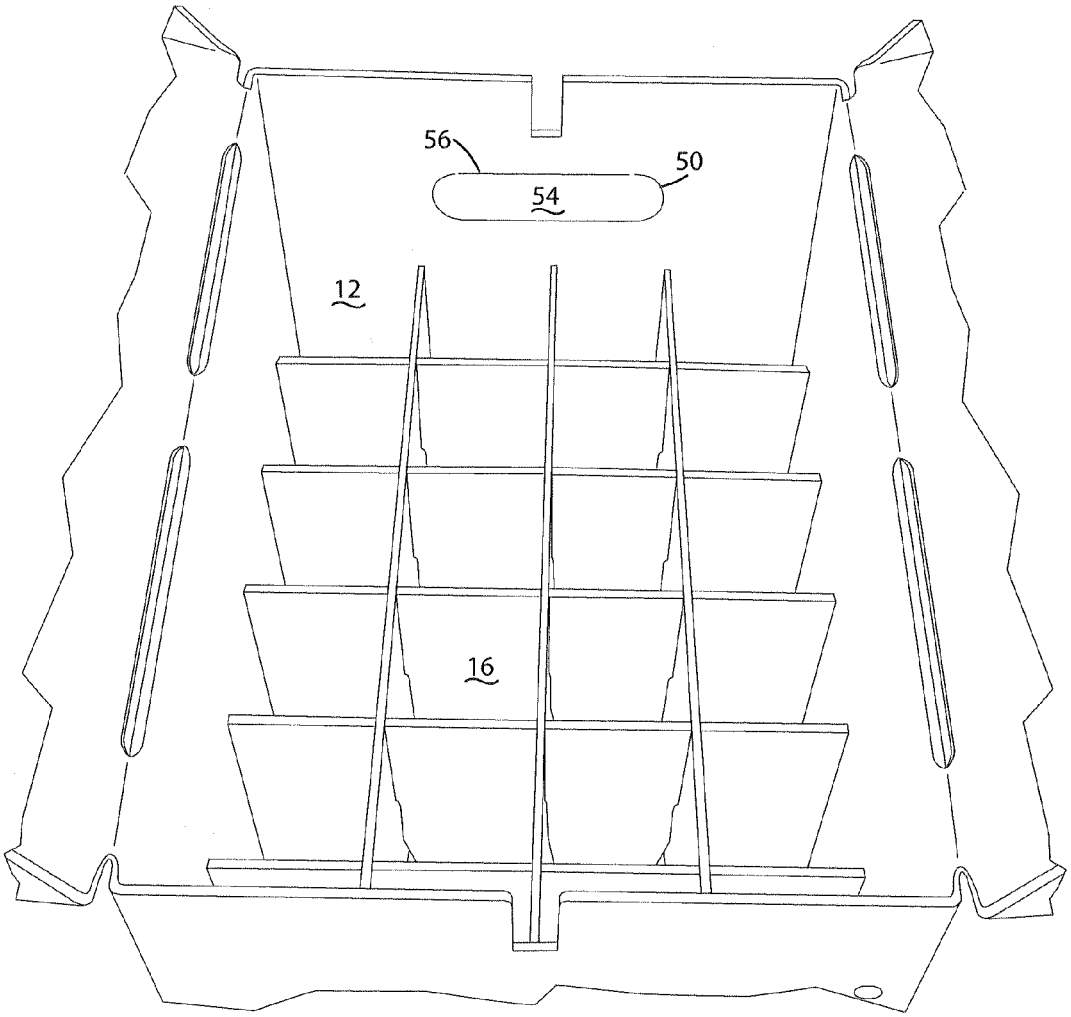
FIG. 7 is a perspective view of the foldable storage case of FIG. 1.

The interior space 12 may be adapted to receive any object known in the art. For example, as illustrated in FIG. 7, the foldable storage case may further comprise a divider 16 adapted to be disposed in the interior space 12. In one embodiment of the present invention, the divider 16 may comprise a waterproof material. Furthermore, in one embodiment of the present invention, when the divider 16 is disposed in the interior space 12, and when the at least one flap 54 of the handle 50 is in the open position and is therefore disposed in the interior space 12, the flap 54 detachably secures the divider 16 in place and prevents the divider 16 from being removed from the interior space 12. In another embodiment of the present invention, the interior space 12 may be further adapted to receive a plurality of bottles. In this embodiment, the divider 16 is adapted to hold the bottles upright and prevent the bottles from making contact with each other during storage or transport. Of course, this is not meant to be limiting in any manner and the interior space 12 may be adapted to receive any bottle or other object known in the art.

In another embodiment of the present invention, the interior space 12 is adapted to receive a plurality of liquid-filled bottles for storage or transport prior to use. In this embodiment, the waterproof material of the container 10 prevents damage that may be caused by the accidental spillage of liquid from the bottles, thereby allowing the container 10 to be reused. Furthermore, the interior space 12 may be further adapted to receive ice or any liquid heating or cooling agent adapted to affect the temperature of the liquid contained in the bottles. The waterproof material of the container 10 prevents the ice or liquid agent from damaging the container 10, thereby allowing the container 10 to be reused.

Figure 8:
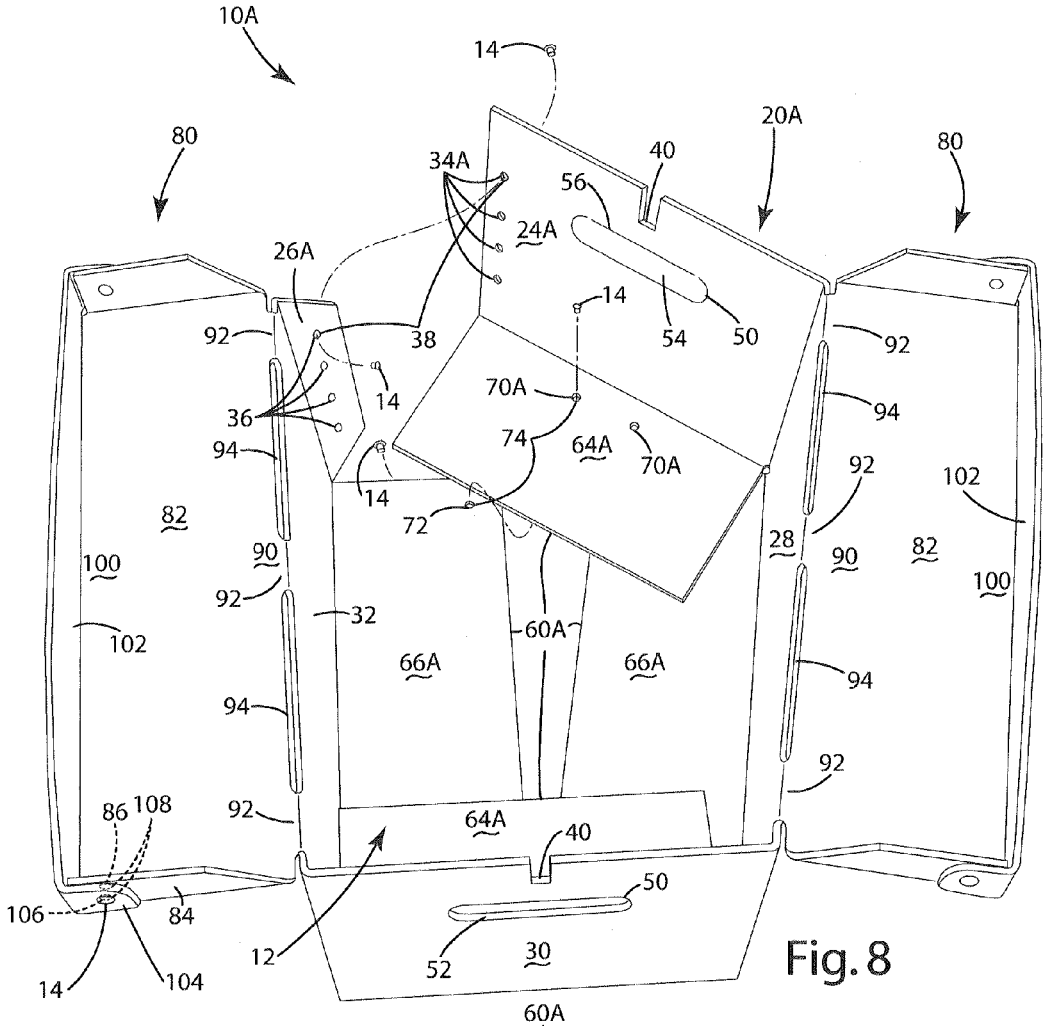
FIG. 8 is a perspective view of another embodiment of the foldable storage case of the present invention.

FIG. 8 illustrates another embodiment 10A comprising a body 20A, a bottom 60A, and a cover 80, wherein the body 20A, the bottom 60A, and the cover 80 are adapted to form an interior space 12 therebetween.

The body 20A comprises a first end panel 24A. The first end panel 24A comprises at least one first body aperture 34A. The first end panel 24A is hingedly joined to a first side panel 28. The first side panel 28 is hingedly joined to a second end panel 30. The second end panel 30 is hingedly joined to a second side panel 32. The second side panel 32 is hingedly joined to a connecting flap 26A. The connecting flap 26A comprises at least one second body aperture 36.

The first end panel 24A and the first side panel 28, the first side panel 28 and the second end panel 30, the second end panel 30 and the second side panel 32, and the second side panel 32 and the connecting flap 26A may be hingedly joined by any method or device as is known in the art. For example, the first end panel 24A and the first side panel 28 may be hingedly joined in any such way that allows the first end panel 24A to be turned, swung, or moved on an axis in relation to the first side panel 28. In one embodiment of the invention, each of the first end panel 24A and the first side panel 28, the first side panel 28 and the second end panel 30, the second end panel 30 and the second side panel 32, and the second side panel 32 and the connecting flap 26A are hingedly joined by at least one scored hinge. In another embodiment, the first end panel 24A and the first side panel 28 may be hingedly joined by using a method or device that is different from the method or device used to hingedly join the first side panel 28 and the second end panel 30, and so on. Of course, this is not meant to be limiting in any way.

The first body aperture 34A and the second body aperture 36 may comprise any aperture known in the art. For example, the first body aperture 34A and the second body aperture 36 may comprise a gap, a hole, an opening, a perforation, a slit, a slot, or the like. Of course, this is not meant to be limiting in any way.

The first end panel 24A, the second end panel 30, the first side panel 28, and the second side panel 32 may comprise any length as is known in the art. For example, in one embodiment, the length x of the first side panel 28 and the second side panel 32 is greater than the length y of the first end panel 24A and the second end panel 30. In another embodiment, the length y of the first end panel 24A and the second end panel 30 is greater than the length x of the first side panel 28 and the second side panel 32. Of course, these examples are not meant to be limiting in any way.

At least one of the first side panel 28, the second side panel 32, the first end panel 24A, and the second end panel 30 further comprises an integral handle 50. The handle comprises a flap 54 adapted to be hingedly joined to the first side panel 28, the second side panel 32, the first end panel 24A, or the second end panel 30 by at least one scored handle hinge 56. The handle hinge 56 is adapted to adjust the flap 54 from a closed position, wherein the flap 54 forms the same plane as the first side panel 28, the second side panel 32, the first end panel 24A, or the second end panel 30, to an open position, wherein the flap 54 is disposed into the interior space 12 of the container 10A, thereby creating a handling aperture 52 whereby a user may use the handling aperture 52 to grasp the container 10A.

The bottom 60A comprises two first bottom panels 64A. Each first bottom panel 64A is hingedly joined to one of the first end panel 24A and the second end panel 30. Each first bottom panel 64A comprises at least one first bottom aperture 70A. The bottom 60A further comprises two second bottom panels 66A. Each second bottom panel 66A is hingedly joined to one of the first side panel 28 and the second side panel 32. Each second bottom panel 66A comprises at least one second bottom aperture 72.

The first bottom panels 64A and second bottom panels 66A may be hingedly joined to the respective first end panel 24A, second end panel 30, first side panel 28, or second side panel 32 by any method or device as is known in the art. For example, the first bottom panels 64A and second bottom panels 66A may be hingedly joined to the respective first end panel 24A, second end panel 30, first side panel 28, or second side panel 32 in any such way that allows the first bottom panels 64A and the second bottom panels 66A to be turned, swung, or moved on an axis in relation to the respective first end panel 24A, second end panel 30, first side panel 28, or second side panel 32. In one embodiment of the invention, each of the first bottom panels 64A and the second bottom panels 66A is hingedly joined to the respective first end panel 24A, second end panel 30, first side panel 28, or second side panel 32 by at least one scored hinge. In another embodiment of the invention, the first bottom panels 64A are hingedly joined to one of the first end panel 24A and the second end panel 30 by using a method or device that is different from the method or device used to hingedly join the second bottom panels 66A to one of the first side panel 28 and the second side panel 32. Of course, this is not meant to be limiting in any way.

The first bottom aperture 70A and the second bottom aperture 72 may comprise any aperture known in the art. For example, the first bottom aperture 70A and the second bottom aperture 72 may comprise a gap, a hole, an opening, a perforation, a slit, a slot, or the like. Of course, this is not meant to be limiting in any way.

The first bottom panels 64A and the second bottom panels 66A may comprise any length as is known in the art. For example, in one embodiment, the length z of the first bottom panels 64A is equal to the length x of the first side panel 28 and the second side panel 32, and the length w of the second bottom panels is equal to the length y of the of the first end panel 24A and the second end panel 30. In another embodiment, the length z of the first bottom panels 64A is shorter to the length x of the first side panel 28 and the second side panel 32, and the length w of the second bottom panels is shorter to the length y of the of the first end panel 24A and the second end panel 30. Of course, these examples are not meant to be limiting in any way.

Figure 9:
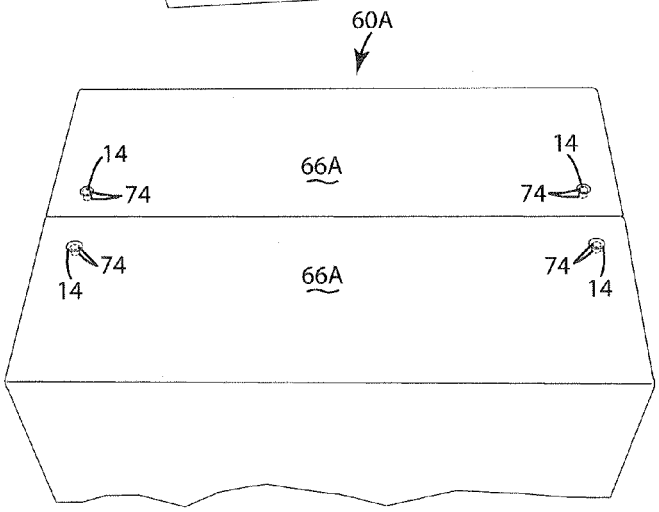
FIG. 9 is a bottom view of the foldable storage case of FIG. 8.

Furthermore, in one embodiment, when the bottom 60A is folded such that the first bottom panels 64A and the second bottom panels 66A are disposed adjacent each other, the second bottom panels 66A are disposed beneath the first bottom panels 64A. In this embodiment, only the second bottom panels 66A are viewable from underneath the container 10A. See, for example, FIG. 9, illustrating the bottom of the container 10A when viewed from underneath.

The cover 80 comprises two cover panels 82. The cover panels 82 comprise a hinged end 90, a free end 100, and two side flaps 84. The hinged end 90 is adapted to be hingedly joined to one of the first end panel 24A, the second end panel 30, the first side panel 28, acid the second side panel 32 by two or more scored cover hinges 92. The cover hinges 92 are disposed apart from each other along the hinged end 90, thereby creating at least one space 94 between the cover hinges 92, thereby reducing contact between the cover panels 82 and the body 20A, thereby increasing flexibility of the hinged end 90 and aiding in adjustment of the cover panels 82.

The free end 100 comprises a projection 102 and two closure flaps 104. The projection 102 is adapted to be received by a receiving area 40 of at least one of the first end panel 24A, the second end panel 30, the first side panel 28, and the second side panel 32. The closure flaps 104 are adapted to be extended from and hingedly joined to the projection 102. The closure flaps 104 comprise at least one end aperture 106.

The side flaps 84 are adapted to be extended from and hingedly joined to the cover panel 82. The side flaps 84 comprise at least one side aperture 86.

The end aperture 106 and the side aperture 86 may comprise any aperture known in the art. For example, the end aperture 106 and the side aperture 86 may comprise a gap, a hole, an opening, a perforation, a slit, a slot, or the like. Of course, this is not meant to be limiting in any way.

The foldable storage case further comprises a plurality of removable fasteners 14. When the body 20A is folded such that the first end panel 24A and the connecting flap 26A overlap, the at least one first body aperture 34A aligns with the at least one second body aperture 36, forming a body aperture pair 38 therethrough, wherein at least one of the fasteners 14 may be disposed in the body aperture pair 38 and thereby fasten together the connecting flap 26A and the first end panel 24A. When the bottom 60A is folded such that at least one of the first bottom panels 64A and at least one of the second bottom panels 66A overlap, the at least one first bottom aperture 70A aligns with the at least one second bottom aperture 72, forming a bottom aperture pair 74 therethrough, wherein at least one of the fasteners 14 may be disposed in the bottom aperture pair 74 and thereby fasten together the first bottom panel 64A and the second bottom panel 66A. When the cover panels 82 are folded such that at least one of the closure flaps 104 and at least one of the side flaps 84 overlap, the at least one end aperture 106 aligns with the at least one side aperture 86, forming a cover aperture pair 108 therethrough, wherein at least one of the fasteners 14 may be disposed in the cover aperture pair 108 and thereby fasten together the closure flap 104 and the side flap 84.

When the cover 80 is folded along the cover hinges 92 such that the projections 102 of the cover panels 82 are disposed adjacent each other within the receiving area 40, the projections 102 and the receiving area 40 interfere with each other such that the projections 102 and the receiving area 40 detachably secure the cover panels 82 in place. See, for example, FIG. 2.

Figure 10:
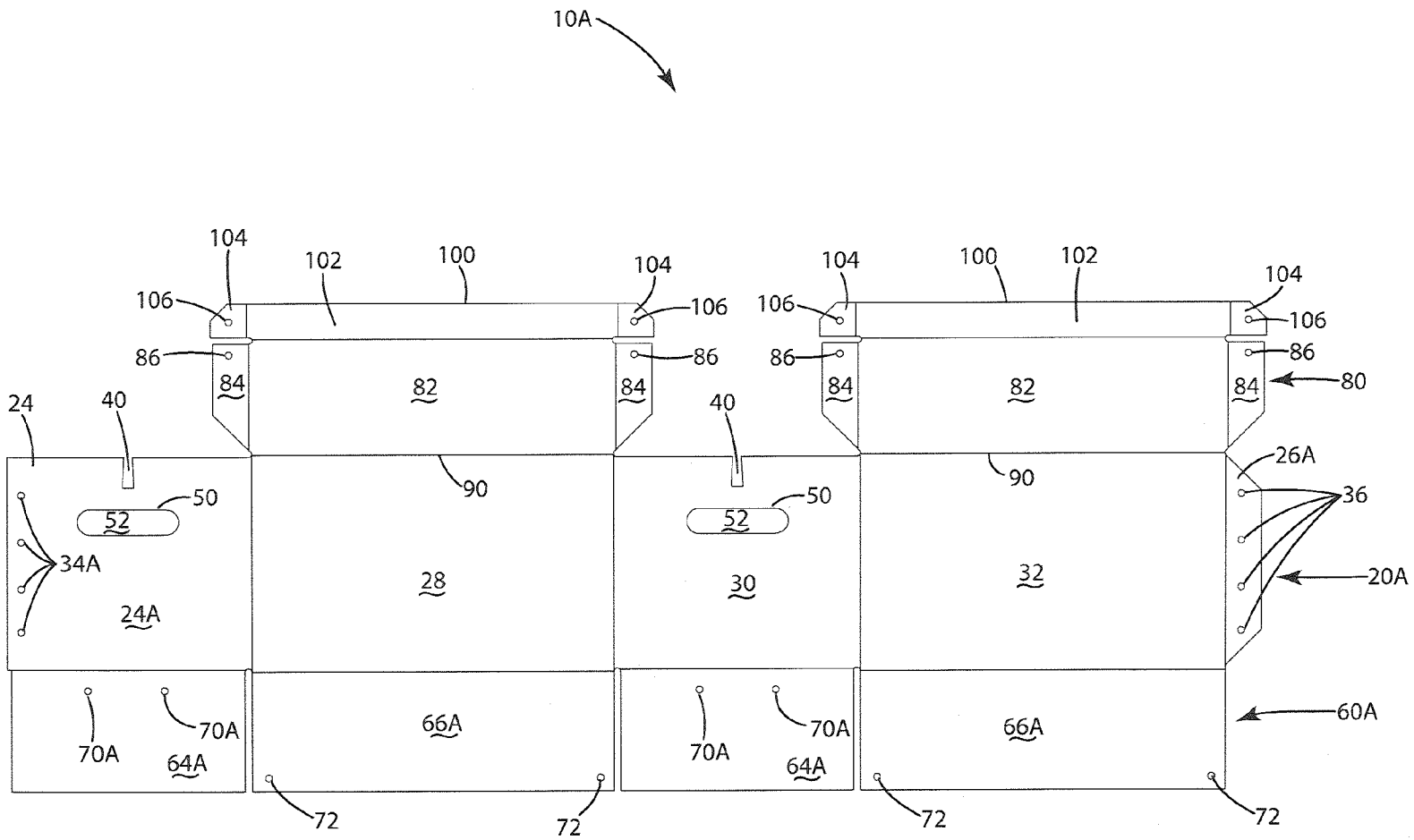
FIG. 10 is a plan view of the foldable storage case of FIG. 8.

Container 10A may perform any function, may be used in any way, and may be configured in any manner as described herein above. In use, the container 10A is adapted to fold from an unassembled position to an assembled position. FIG. 10 illustrates an embodiment of the present invention wherein the container 10A is in the unassembled position. When in the unassembled position, the container 10A is disposed in a flat configuration and is therefore adapted to be easily packaged and shipped. Referring now to FIG. 8, when a user desires to use the container 10A, the user may fold the container 10A to the assembled position, wherein the fasteners 14 are disposed in the body aperture pair 38 and the bottom aperture pair 74, thereby fastening together the first end panel 24A and the connecting flap 26A, and the first bottom panels 64A and the second bottom panels 66A, respectively. When in the assembled position the container 10A is adapted to receive various objects in the interior space 12. In one embodiment, when the container 10A is in the assembled position, the first end panel 24A and the second end panel 30 are disposed parallel to each other, and the first side panel 28 and the second side panel 32 are disposed parallel to each other, thereby forming a rectangular shape, and the first bottom panels 64A and the second bottom panels 66A are disposed adjacent each other, forming a plane that is perpendicular to the first end panel 24A, the second end panel 30, the first side panel 28, and the second side panel 32.

Figure 11:
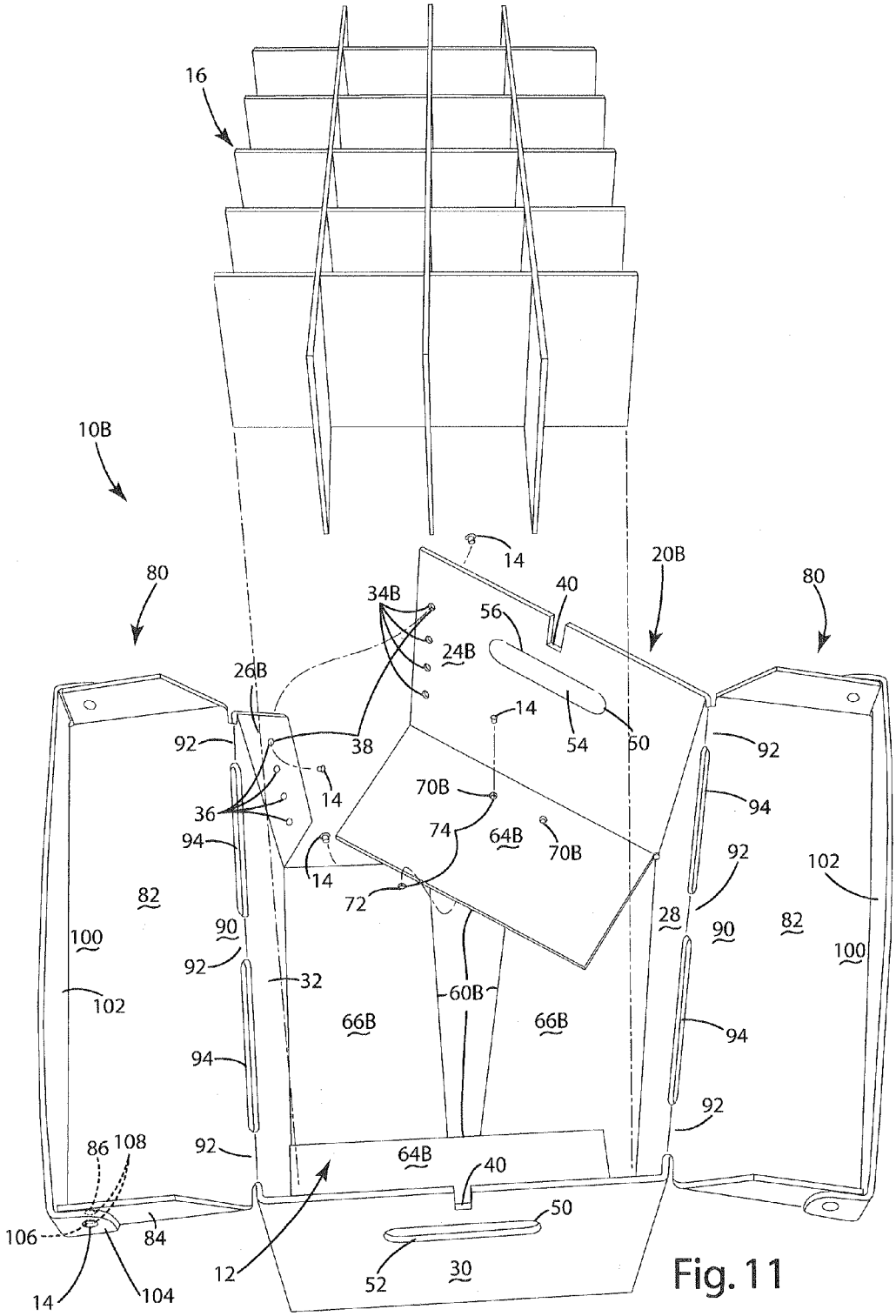
FIG. 11 is a perspective view of another embodiment of the foldable storage case of the present invention.

FIG. 11 illustrates another embodiment 10B comprising a body 20B, a bottom 60B, and a cover 80, wherein the body 20B, the bottom 60B, and the cover 80 are adapted to form an interior space 12 therebetween.

The body 20B comprises a first end panel 24B. The first end panel 24B comprises at least one first body aperture 34B. The first end panel 24B is hingedly joined to a first side panel 28. The first side panel 28 is hingedly joined to a second end panel 30. The second end panel 30 is hingedly joined to a second side panel 32. The second side panel 32 is hingedly joined to a connecting flap 26B. The connecting flap 26B comprises at least one second body aperture 36. In this embodiment of the present invention, the length x of the first side panel 28 and the second side panel 32 is greater than the length y of the first end panel 24B and the second end panel 30.

At least one of the first end panel 24B and the second end panel 30 further comprises an integral handle 50. The handle 50 comprises a flap 54 adapted to be hingedly joined to the first end panel 24B or the second end panel 30 by at least one scored handle hinge 56. The handle hinge 56 is adapted to adjust the flap 54 from a closed position, wherein the flap 54 forms the same plane as the first end panel 24B or the second end panel 30, to an open position, wherein the flap 54 is disposed into the interior space 12 of the container 10B, thereby creating a handling aperture 52 whereby a user may use the handling aperture 52 to grasp the container 10B.

The bottom 60B comprises two first bottom panels 64B. Each first bottom panel 64B is hingedly joined to one of the first end panel 24B and the second end panel 30. Each first bottom panel 64B comprises at least one first bottom aperture 70B. The bottom 60B further comprises two second bottom panels 66B. Each second bottom panel 66B is hingedly joined to one of the first side panel 28 and the second side panel 32. Each second bottom panel 66B comprises at least one second bottom aperture 72.

The cover 80 comprises two cover panels 82. The cover panels 82 comprise a hinged end 90, a free end 100, and two side flaps 84. The hinged end 90 is adapted to be hingedly joined to one of the first side panel 28 and the second side panel 32 by two or more scored cover hinges 92. The cover hinges 92 are disposed apart from each other along the hinged end 90, thereby creating at least one space 94 between the cover hinges 92, thereby reducing contact between the cover panels 82 and the body 20B, thereby increasing flexibility of the hinged ends 90 and aiding in adjustment of the cover panels 82.

The free end 100 comprises a projection 102 and two closure flaps 104. The projection 102 is adapted to be received by a receiving area 40 of at least one of the first end panel 24B and the second end panel 30. The closure flaps 104 are adapted to be extended from and hingedly joined to the projection 102. The closure flaps 104 comprise at least one end aperture 106.

The side flaps 84 are adapted to be extended from and hingedly joined to the cover panel 82. The side flaps 84 comprise at least one side aperture 86.

The foldable storage case further comprises a plurality of removable fasteners 14. The fasteners 14 comprise screws. The foldable storage case still further comprises a divider 16 adapted to be disposed in the interior space 12 of the container 10B.

When the body 20B is folded such that the first end panel 24B and the connecting flap 26B overlap, the at least one first body aperture 34B aligns with the at least one second body aperture 36, forming a body aperture pair 38 therethrough, wherein at least one of the fasteners 14 may be disposed in the body aperture pair 38 and thereby fasten together the connecting flap 26B and the first end panel 24B. Furthermore, when the bottom 60B is folded such that at least one of the first bottom panels 64B and at least one of the second bottom panels 66B overlap, the at least one first bottom aperture 70B aligns with the at least one second bottom aperture 72, forming a bottom aperture pair 74 therethrough, wherein at least one of the fasteners 14 may be disposed in the bottom aperture pair 74 and thereby fasten together the first bottom panel 64B and the second bottom panel 66B. Still further, when the cover panels 82 are folded such that at least one of the closure flaps 104 and at least one of the side flaps 84 overlap, the at least one end aperture 106 aligns with the at least one side aperture 86, forming a cover aperture pair 108 therethrough, wherein at least one of the fasteners 14 may be disposed in the cover aperture pair 108 and thereby fasten together the closure flap 104 and the side flap 84.

When the cover 80 is folded along the cover hinges 92 such that the projections 102 of the cover panels 82 are disposed adjacent each other within the receiving area 40, the projections 102 and the receiving area 40 interfere with each other such that the projections 102 and the receiving area 40 detachably secure the cover panels 82 in place. See, for example, FIG. 2.

When the divider 16 is disposed in the interior space 12 of the container 10B, and when the at least one flap 54 of the handle 50 is in the open position, the flap 54 detachably secures the divider 16 in place and prevents the divider 16 from being removed from the interior space 12 of the container 10B.

Container 10B may perform any function, may be used in any way, and may be configured in any manner as described herein above. In use, the container 10B is adapted to fold from an unassembled position to an assembled position. When in the unassembled position, the container 10B is disposed in a flat configuration and is therefore adapted to be easily packaged and shipped. When a user desires to use the container 10B, the user may fold the container 10B to the assembled position, wherein the fasteners 14 are disposed in the body aperture pair 38 and the bottom aperture pair 74, thereby fastening together the first end panel 24B and the connecting flap 26B, and the first bottom panels 64B and the second bottom panels 66B, respectively. When in the assembled position the container 10B is adapted to receive various objects in the interior space 12. In one embodiment, when the container 10B is in the assembled position, the first end panel 24B and the second end panel 30 are disposed parallel to each other, and the first side panel 28 and the second side panel 32 are disposed parallel to each other, thereby forming a rectangular shape, and the first bottom panels 64B and the second bottom panels 66B are disposed adjacent each other, forming a plane that is perpendicular to the first end panel 24B, the second end panel 30, the first side panel 28, and the second side panel 32.

The solutions offered by the invention disclosed herein have thus been attained in an economical, practical, and facile manner. To wit, a novel foldable storage case which is waterproof, portable, durable, reusable, and easy to assemble has been invented. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to be appreciated that various changes, rearrangements, and modifications may be made therein, without departing from the scope of the invention as defined by the claims.

The invention claimed is:

1. A foldable storage case comprising:

a one-piece container comprising a body, a bottom, and a cover, wherein the body, the bottom, and the cover are adapted to form an interior space therebetween;

the body comprising a plurality of body panels, at least one of the body panels comprising a first overlapping body area, at least one of the body panels comprising a second overlapping body area adapted to be disposed adjacent the first overlapping body area, wherein the first overlapping body area and the second overlapping body area comprise at least one body aperture, wherein when the first overlapping body area and the second overlapping body area overlap, the body aperture of the first overlapping body area and the body aperture of the second overlapping body area align to form a body aperture pair therethrough;

the bottom comprising a plurality of bottom panels, each bottom panel hingedly joined to at least one of the body panels, at least one of the bottom panels comprising a first overlapping bottom area, at least one of the bottom panels comprising a second overlapping bottom area adapted to be disposed adjacent the first overlapping bottom area, wherein the first overlapping bottom area and the second overlapping bottom area comprise at least one bottom aperture, wherein when the first overlapping bottom area and the second overlapping bottom area overlap, the bottom aperture of the first overlapping bottom area and the bottom aperture of the second overlapping bottom area align to form a bottom aperture pair therethrough;

the cover comprising a plurality of cover panels, the cover panels comprising a hinged end and a free end, the hinged end adapted to be hingedly joined to one of the body panels by at least one cover hinge, the free end comprising a projection adapted to be received by a receiving area of at least one of the body panels, wherein when the cover is folded along the cover hinge such that the projections of at least two of the cover panels are disposed adjacent each other within the receiving area, the projections and the receiving area interfere with each other such that the projections and the receiving area detachably secure the cover panels in place;

a plurality of removable fasteners adapted to be disposed in the body aperture pair and the bottom aperture pair, thereby fastening together the body panels and the bottom panels, respectively;

wherein the free end of the cover panels further comprises two closure flaps, the closure flaps adapted to be extended from and hingedly joined to the projection, the closure flaps comprising at least one end aperture.

2. The foldable storage case of claim 1, wherein the cover panels further comprise two side flaps, the side flaps adapted to be extended from and hingedly joined to the cover panel, the side flaps comprising at least one side aperture.

3. The foldable storage case of claim 2, wherein when the cover panels are folded such that at least one of the closure flaps and at least one of the side flaps overlap, the at least one end aperture and the at least one side aperture align to form a cover aperture pair therethrough, wherein at least one of the fasteners may be disposed in the cover aperture pair and thereby fasten together the closure flap and the side flap.

4. A foldable storage case comprising:

a one-piece container comprising a waterproof material, the container comprising a body, a bottom, and a cover, wherein the body, the bottom, and the cover are adapted to form an interior space therebetween;

the body comprising a first end panel, the first end panel comprising at least one first body aperture, the first end panel hingedly joined to a first side panel, the first side panel hingedly joined to a second end panel, the second end panel hingedly joined to a second side panel, the second side panel hingedly joined to a connecting flap, the connecting flap comprising at least one second body aperture;

at least one of the first side panel, the second side panel, the first end panel, and the second end panel further comprising an integral handle, the handle comprising a flap adapted to be hingedly joined to the first side panel, the second side panel, the first end panel, or the second end panel by at least one scored handle hinge, the handle hinge adapted to adjust the flap from a closed position, wherein the flap forms the same plane as the first side panel, the second side panel, the first end panel, or the second end panel, to an open position, wherein the flap is disposed into the interior space of the container, thereby creating a handling aperture whereby a user may use the handling aperture to grasp the container;

the bottom comprising two first bottom panels, each first bottom panel hingedly joined to one of the first end panel and the second end panel, each first bottom panel comprising at least one first bottom aperture, the bottom further comprising two second bottom panels, each second bottom panel hingedly joined to one of the first side panel and the second side panel, each second bottom panel comprising at least one second bottom aperture;

the cover comprising two cover panels, the cover panels comprising a hinged end, a free end, and two side flaps;

the hinged end adapted to be hingedly joined to one of the first end panel, the second end panel, the first side panel, and the second side panel by two or more scored cover hinges, the cover hinges disposed apart from each other along the hinged end, thereby creating at least one space between the cover hinges, thereby reducing contact between the cover panels and the body, thereby increasing flexibility of the hinged end and aiding in adjustment of the cover panels;

the free end comprising a projection and two closure flaps, the projection adapted to be received by a receiving area of at least one of the first end panel, the second end panel, the first side panel, and the second side panel, the closure flaps adapted to be extended from and hingedly joined to the projection, the closure flaps comprising at least one end aperture;

the side flaps adapted to be extended from and hingedly joined to the cover panel, the side flaps comprising at least one side aperture;

a plurality of removable fasteners;

wherein when the body is folded such that the first end panel and the connecting flap overlap, the at least one first body aperture aligns with the at least one second body aperture, forming a body aperture pair therethrough, wherein at least one of the fasteners may be disposed in the body aperture pair and thereby fasten together the connecting flap and the first end panel;

wherein when the bottom is folded such that at least one of the first bottom panels and at least one of the second bottom panels overlap, the at least one first bottom aperture aligns with the at least one second bottom aperture, forming a bottom aperture pair therethrough, wherein at least one of the fasteners may be disposed in the bottom aperture pair and thereby fasten together the first bottom panel and the second bottom panel;

wherein when the cover panels are folded such that at least one of the closure flaps and at least one of the side flaps overlap, the at least one end aperture aligns with the at least one side aperture, forming a cover aperture pair therethrough, wherein at least one of the fasteners may be disposed in the cover aperture pair and thereby fasten together the closure flap and the side flap;

wherein when the cover is folded along the cover hinges such that the projections of the cover panels are disposed adjacent each other within the receiving area, the projections and the receiving area interfere with each other such that the projections and the receiving area detachably secure the cover panels in place.

5. The foldable storage case of claim 4, wherein the container further comprises a corrugated plastic material.

6. The foldable storage case of claim 4, wherein the fasteners comprise screws.

7. The foldable storage case of claim 4, wherein the receiving area comprises a U-shaped slot.

8. The foldable storage case of claim 4, wherein a length x of the first side panel and the second side panel is greater than a length y of the first end panel and the second end panel.

9. The foldable storage case of claim 4, wherein when the bottom of the container is folded such that the first bottom panels and the second bottom panels are disposed adjacent each other, the second bottom panels are disposed beneath the first bottom panels.

10. The foldable storage case of claim 4, further comprising a divider adapted to be disposed in the interior space of the container, wherein when the divider is disposed in the interior space of the container, and when at least one of the flaps of the handles is in the open position, the flap detachably secures the divider in place and prevents the divider from being removed from the interior space of the container.

11. A foldable storage case comprising:

a one-piece container comprising a waterproof material, the container comprising a body, a bottom, and a cover, wherein the body, the bottom, and the cover are adapted to form an interior space therebetween;

the body comprising a first end panel, the first end panel comprising at least one first body aperture, the first end panel hingedly joined to a first side panel, the first side panel hingedly joined to a second end panel, the second end panel hingedly joined to a second side panel, the second side panel hingedly joined to a connecting flap, the connecting flap comprising at least one second body aperture;

wherein a length x of the first side panel and the second side panel is greater than a length y of the first end panel and the second end panel;

at least one of the first end panel and the second end panel further comprising an integral handle, the handle comprising a flap adapted to be hingedly joined to the first end panel or the second end panel by at least one scored handle hinge, the handle hinge adapted to adjust the flap from a closed position, wherein the flap forms the same plane as the first end panel or the second end panel, to an open position, wherein the flap is disposed into the interior space of the container, thereby creating a handling aperture whereby a user may use the handling aperture to grasp the container;

the bottom comprising two first bottom panels, each first bottom panel hingedly joined to one of the first end panel and the second end panel, each first bottom panel comprising at least one first bottom aperture, the bottom further comprising two second bottom panels, each second bottom panel hingedly joined to one of the first side panel and the second side panel, each second bottom panel comprising at least one second bottom aperture;

the cover comprising two cover panels, the cover panels comprising a hinged end, a free end, and two side flaps;

the hinged end adapted to be hingedly joined to one of the first side panel and the second side panel by two or more scored cover hinges, the cover hinges disposed apart from each other along the hinged end, thereby creating at least one space between the cover hinges, thereby reducing contact between the cover panels and the body, thereby increasing flexibility of the hinged ends and aiding in adjustment of the cover panels;

the free end comprising a projection and two closure flaps, the projection adapted to be received by a receiving area of at least one of the first end panel and the second end panel, the closure flaps adapted to be extended from and hingedly joined to the projection, the closure flaps comprising at least one end aperture;

the side flaps adapted to be extended from and hingedly joined to the cover panel, the side flaps comprising at least one side aperture;

a plurality of removable fasteners, the fasteners comprising screws; and a divider adapted to be disposed in the interior space of the container;

wherein when the body is folded such that the first end panel and the connecting flap overlap, the at least one first body aperture aligns with the at least one second body aperture, forming a body aperture pair therethrough, wherein at least one of the fasteners may be disposed in the body aperture pair and thereby fasten together the connecting flap and the first end panel;

wherein when the bottom is folded such that at least one of the first bottom panels and at least one of the second bottom panels overlap, the at least one first bottom aperture aligns with the at least one second bottom aperture, forming a bottom aperture pair therethrough, wherein at least one of the fasteners may be disposed in the bottom aperture pair and thereby fasten together the first bottom panel and the second bottom panel;

wherein when the cover panels are folded such that at least one of the closure flaps and at least one of the side flaps overlap, the at least one end aperture aligns with the at least one side aperture, forming a cover aperture pair therethrough, wherein at least one of the fasteners may be disposed in the cover aperture pair and thereby fasten together the closure flap and the side flap;

wherein when the cover is folded along the cover hinges such that the projections of the cover panels are disposed adjacent each other within the receiving area, the projections and the receiving area interfere with each other such that the projections and the receiving area detachably secure the cover panels in place;

wherein when the divider is disposed in the interior space of the container, and when the at least one flap of the handle is in the open position, the flap detachably secures the divider in place and prevents the divider from being removed from the interior space of the container.

* * * * *